US005619867A

United States Patent [19]

Slaughter

[11] Patent Number: 5,619,867

[45] Date of Patent: Apr. 15, 1997

[54] APPARATUS FOR MAINTAINING LIQUID TEMPERATURE

[76] Inventor: Marion W. Slaughter, 1902 Spillers, Houston, Tex. 77043

[21] Appl. No.: 615,050

[22] Filed: Mar. 12, 1996

[51] Int. Cl.[6] ..... F25D 3/08

[52] U.S. Cl. ..... 62/530; 62/371; 62/457.2

[58] Field of Search ..... 62/371, 457.1, 62/457.2, 457.3, 530

[56] References Cited

U.S. PATENT DOCUMENTS 1,048,851 12/1912 Moore ..... 62/457.1
1,835,463 12/1931 Campbell ..... 62/457.1
2,024,082 12/1935 Woodruff ..... 62/457.2
4,656,840 4/1987 Loofbourrow et al. ..... 62/530

*Primary Examiner*—William Doerrler
*Attorney, Agent, or Firm*—Bill B. Berryhill

[57] ABSTRACT

Apparatus for cooling and retarding an increase in the temperature of a liquid contained in a vessel. The apparatus includes a base for substantially occupying the lower interior of liquid containing vessel and a cooling body for upward projection from the base so that when the base is placed in the vessel the cooling body projects upwardly therefrom for submersion in the liquid. The cooling body comprises a sealed container substantially filled with a slow-to-freeze, slow-to-thaw gelatinous material which may be frozen prior to submersion in the liquid.

19 Claims, 2 Drawing Sheets

APPARATUS FOR MAINTAINING LIQUID TEMPERATURE

BACKGROUND OF THE INVENTION

1. Field of the Invention

The present invention pertains to apparatus for maintaining the temperature of a liquid. Specifically, the present invention pertains to apparatus for cooling a liquid and/or retarding an increase in liquid temperature, due to external influences. More specifically, the present invention pertains to apparatus suitable for cooling and retarding increases in temperature of water contained in a bait container or vessel.

2. Description of the Prior Art

Both commercial fisherman and those who fish for sport generally prefer live bait, e.g. shrimp, minnows, etc. The live bait is usually placed in a water filled vessel of some type, the water being at a temperature approximating the temperature of the water from which the bait is removed. Many boats are provided with such a vessel, sometimes referred to as a "bait well". Others simply place the live bait in a bucket or some other type of vessel.

Shrimp, minnows and other live bait can only survive with a sufficient oxygen supply and in a habitat of certain temperature ranges. As water temperature increases, the water holds less oxygen. In warm water, the metabolism of cold blooded animals, such as shrimp and fish, tends to speed up, increasing oxygen consumption and toxic waste production. It is therefore necessary, to keep the water cool, preferably around 70° F. in the summer. At this temperature, bait will not only use less oxygen, but the water will more easily absorb oxygen when aerated. If live shrimp are caught or purchased from water at a temperature greater than 70° F., the water in which they are kept should be cooled to as near 70° F. as possible. However, the shrimp should be gradually acclimated to this temperature in the bait container. Shrimp can tolerate a change of 5° F. per half hour. However, a change more abrupt than this will shock the shrimp.

Many fishermen begin fishing early in the morning, the coolest part of the day. However, as the day progresses, the bait well or other vessel containing the bait is subjected to increasing temperatures and in many cases direct exposure to the sun. As this occurs, the temperature of the water in which the bait is contained increases, sometimes by as much as 10° F. to 20° F. Due to the increased metabolism of the bait, increased oxygen consumption and toxic waste production, the bait may die in just two hours. It is common knowledge that dead bait is not as attractive to fish as live bait.

Large commercial fishing vessels may be provided with bait wells which are refrigerated. Such refrigeration systems require a source of power and are relatively expensive, particularly for the small commercial fisherman or the pleasure fisherman. In the past, the most convenient way for the small commercial fisherman or pleasure fisherman to cool the water in which the bait is placed has been to add ice thereto. However, ice melts rapidly and must be continuously replenished. Furthermore, unless the ice is made from a composition of water similar to the water in which the bait is held, the ice water may alter the salinity or other composition of the water in which the bait is held. Although salinity is not as critical as temperature, changes in water composition also contribute to death of the bait. More satisfactory solutions for keeping bait alive over a longer period of time are needed.

SUMMARY OF THE PRESENT INVENTION

In the present invention, apparatus is provided for cooling and retarding an increase in the temperature of a liquid, such as water, contained in a vessel which is subject to external influences. The apparatus comprises a base the outer perimeter of which, when placed in the vessel, substantially occupies the lower interior of the liquid containing vessel. A cooling body is associated with the base so that when the base is placed in the liquid containing vessel the cooling body projects upwardly from the base for submersion in the liquid in the vessel. The cooling body includes a sealed container substantially filled with a slow-to-freeze, slow-to-thaw gelatinous material which may be frozen prior to submersion in the liquid.

In a preferred embodiment of the invention, the base is a separate unit having a central opening therethrough through which the cooling body may be removably inserted. Thus the cooling body and base may be separately placed in a freezer for freezing the gelatinous material therein prior to disposition in a vessel or container.

The base is preferably of a specific weight which is enough greater than the specific weight of the liquid to keep the base and the cooling body submerged in the liquid. For this purpose, the base may be provided with one or more compartments in which weights may be placed to increase its specific weight. The base may also be provided with one or more compartments in which additional slow-to-freeze, slow-to-thaw gelatinous material may be placed. The gelatinous material in the sealed container and compartments of the base may be surrounded by insulation to provide a rate of heat transfer which will prevent the temperature of the liquid in the vessel from being raised or lowered more than 5° F. per half hour for a period of at least eight hours.

The base is designed so that when placed in the vessel it substantially occupies the lower interior thereof. The cooling body is preferably designed without sharp edges and may be frusto-conical in shape. The fact that the base is essentially fixed in the bottom of the vessel and the apparatus presents no sharp corners prevents harm to the bait and interference with nets or other devices used to remove bait from the vessel.

Thus, the present invention provides apparatus for cooling and maintaining the temperature of liquid, specifically water, in a vessel in which bait or other fish may be placed so that the bait will live for a substantial period of time, eight hours or longer, even though the ambient temperature increases and even though the vessel is subjected to the sun. The apparatus is simple to manufacture, inexpensive and especially easy to use. It would be available to any fisherman. Many other objects and advantages of the invention will be apparent from reading the description which follows in conjunction with the accompanying drawings.

DESCRIPTION OF THE PREFERRED EMBODIMENTS

Figure 1:
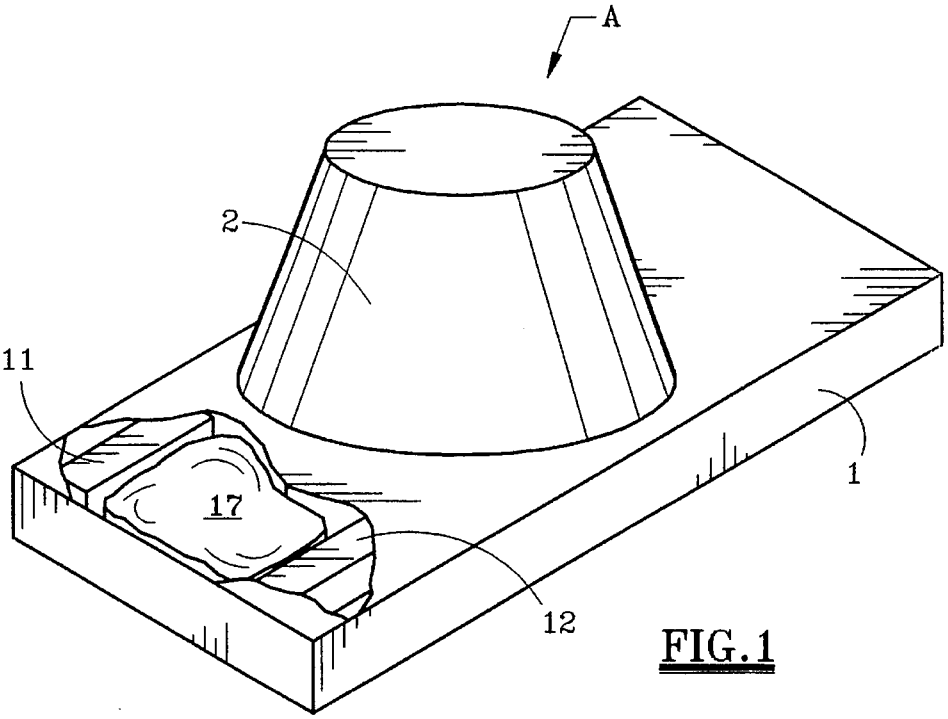
FIG. 1 is an isometric view of the apparatus of the present invention, a portion of which has been broken away for viewing the interior thereof, according to a preferred embodiment of the invention.

Referring first to FIG. 1, there is shown the apparatus A of the present invention. The apparatus A includes a base 1 and a cooling body 2. While the base 1 and cooling body 2 may be manufactured as a single unit, it is preferable that they be separate units which may be assembled as shown in FIG. 1. FIG. 1 illustrates a portion of the base 1 broken away to reveal the interior thereof which includes weights 11, 12 such as lead, and a packet of gelatinous material 17 which will be more fully described hereafter. The purpose of the apparatus A of the present invention is to cool and retard an increase in the temperature of liquid contained in a vessel, e.g. water in a bait container.

Figure 2:
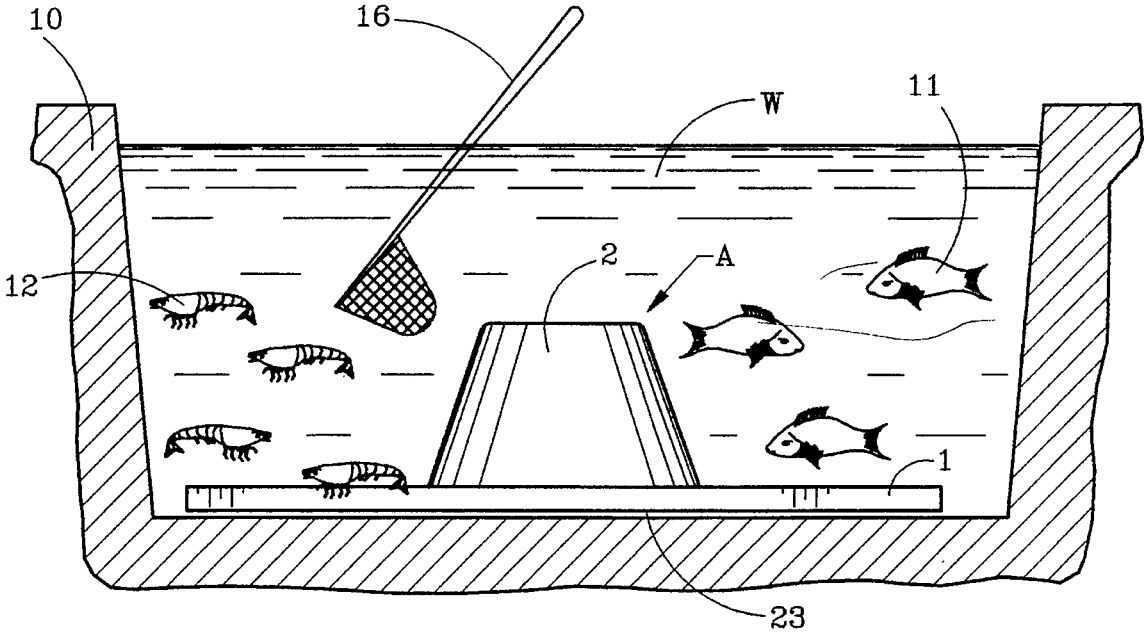
FIG. 2 is an elevation view of a container well or vessel, in section, showing the apparatus of the present invention as used therein.

FIG. 2 illustrates a bait container 10 filled with water W and containing small fish 11, shrimp 12 or any other bait or fish. Actually, the types of bait would not be mixed. The outer perimeter of the base 1 is shaped so that it substantially occupies the lower interior of the liquid containing vessel 10. A small net 16 is illustrated for removing bait.

Figure 3:
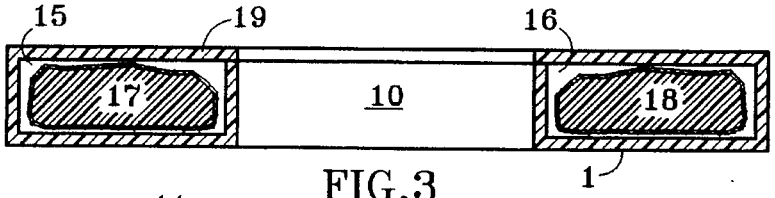
FIG. 3 is a cross-sectional side view of the base portion of the apparatus of the present invention, as taken along lines 3—3 of FIG. 4.
Figure 4:
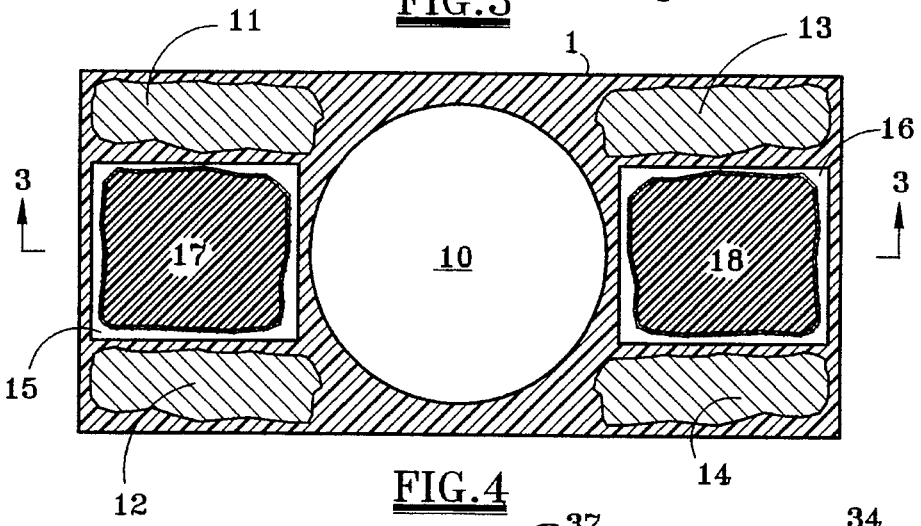
FIG. 4 is a plan view, in section, of the base portion of the apparatus of the invention, according to a preferred embodiment thereof.
Figure 5:
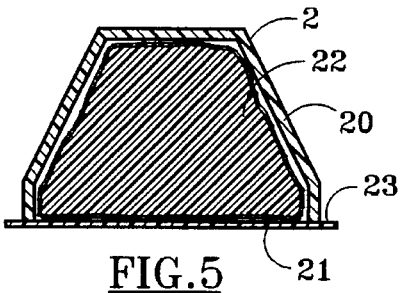
FIG. 5 is a cross-sectional view of a cooling body portion of the present invention, taken along lines 5—5 of FIG. 6, according to a preferred embodiment of the invention.

Referring now to FIGS. 3–6, the apparatus A of the present invention, as illustrated in FIGS. 1 and 2, will be described in greater detail. The base 1, as shown in FIGS. 3 and 4, has a central opening 10 therethrough. The purpose of the central opening 10 is to receive the cooling body 2 shown in FIGS. 5 and 6. When the cooling body 2 is properly inserted in the central opening 10 it projects upwardly from the base 1 so that when the base is placed in a vessel, such as the bait container 10 in FIG. 2, the cooling body 2 projects upwardly from the base for submersion in the liquid in vessel, i.e. water W.

The cooling body 1 comprises a frusto-conical container 20 closed at its base by a circular closure member 21. The interior of the container 20 is filled with a gelatinous material 22. After the gel is in place the closure member 21 would be sealingly attached to the container 20. The base of the container 20 is of a diameter slightly less than the central opening 10 through to base 1. However, the closure member 21 may be of a slightly greater diameter providing an annular lip 23 which, when the cooling body 2 is inserted upwardly through the central opening 10 of the base 1, prevents the base of the container 20 from exiting the central opening 10 removably connecting the base 1 and cooling body 2 in the assembly illustrated in FIGS. 1 and 2.

The gelatinous material 22 may be poured directly into the container 20 or first placed in a bag and then in the container 20. The gelatinous material 22 is a slow-to-freeze, slow-to-thaw material and is preferably a blend of water soluble polymers derived from cellulose, a natural carbohydrate containing the univalent hydroxyl group OH. While the container 20 would be substantially filled with the gelatinous material 22, a small amount of space, e.g. 5%, will be left in the container 20 to accommodate expansion of the gelatinous material upon freezing thereof. The container 20 or the bag in which the gelatinous material 22 is contained is preferably insulated or provided with a layer of insulating material having a preselected R-value, e.g. 1.14 R.

$$\text{where } R\text{-Value} = \frac{\text{hr} \times \text{ft}^2 \times {}^\circ\text{F.}}{\text{BTU}}$$

As previously stated, the base 1 has an outer perimeter which substantially occupies the lower interior of the vessel in which it will be used. In the illustrated embodiment of FIGS. 1, 2, 3 and 4, the base 1 is rectangular in shape and is longer than it is wide. Opposite ends of the base 1 are provided with one or more compartments or cavities in which one or more weights, such as lead weights 11, 12, 13 and 14, may be provided. The purpose of the weights is to increase the specific weight of the base to be enough greater than the specific weight of the liquid so as to keep the base 1 and the cooling body 2 submerged in the liquid, water w as illustrated in FIG. 2. It's very important to keep the base and cooling body 2 from moving since they could injure the bait.

Also provided in the base 1 is one or more compartments or cavities 15, 16 in which additional slow-to-freeze, slow-to-thaw gelatinous material 17, 18 may be placed. After placement of lead weights 11–14 and gelatinous material in their respective compartments and cavities the top 19 would be sealingly attached. In the preferred embodiment, the amount of gelatinous material 17, 18 in the cavities 15, 16 is generally less than the amount of gelatinous material (gel) 22 in the cooling body container 20. For example, the container 20 might contain three pounds of gel whereas each of the compartments 15, 16 might contain one pound of gel each. The gel may be placed directly in the cavities 15, 16. However, it is preferable that the gel be in bags These compartments 15, 16 or the bags in which the gel 17, 18 is contained are preferably insulated with material of preselected rates of heat transfer. More will be discussed about this fact hereafter.

Figure 7:
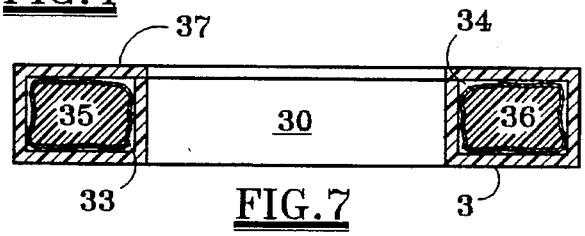
FIG. 7 is a cross-sectional side view of a base portion of the apparatus of the present invention, taken along lines 7—7 of FIG. 8, illustrating an alternate embodiment of the invention.
Figure 6:
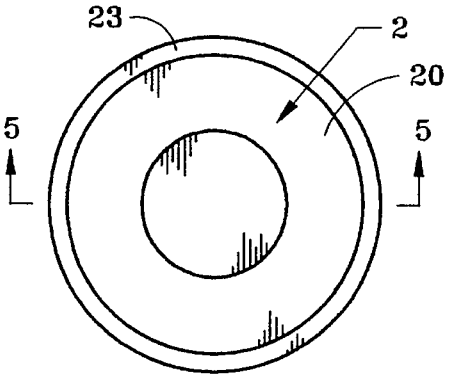
FIG. 6 is a top view of the cooling body portion of FIG. 5.
Figure 8:
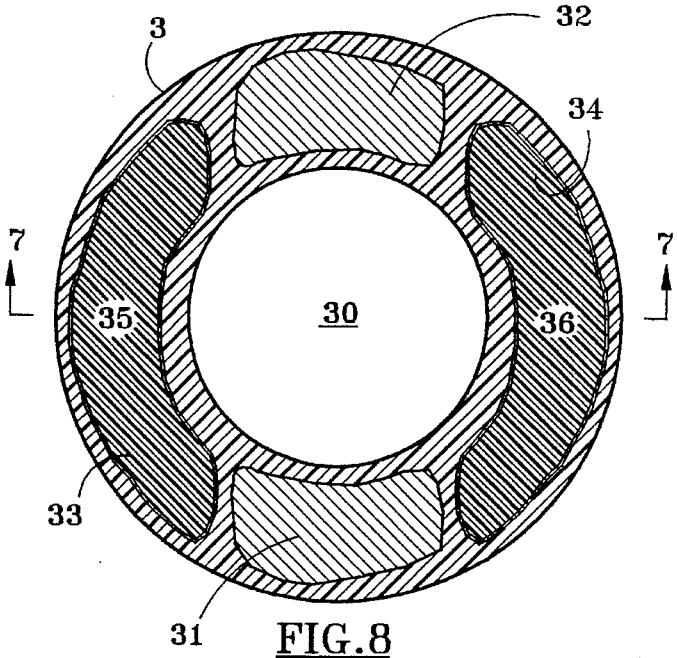
FIG. 8 is a plan view, in section, of the base portion of FIG. 7.

FIGS. 7 and 8 illustrate a base 3 for another embodiment of the invention in which the apparatus is utilized with a circular vessel such as a bucket. The base 3 would simply replace the base 1. The same cooling body 2 could be utilized with the base 3. The outer perimeter of the base 3 is circular and would, when placed in a bucket, substantially occupy the lower interior of the bucket container. The base 3 is provided with a central opening 30 which would receive the base of the cooling body 2 in the same manner as previously described with base 1. Like the base 1 in the embodiments of FIGS. 3 and 4, base 3 would be provided with one or more cavities or compartments in which weights, such as lead weights 31, 32, could be placed to increase the specific weight of the base 3. One or more compartments 33, 34 would be provided for placement of additional slow-to-freeze, slow-to-thaw gelatinous material 35, 36. These compartments would be permanently sealed by closure members or by the upper wall 37 of the base 3. The compartments 33, 34 and/or the bags in which the gelatinous material 35, 36 is contained would be insulated by materials of preselected rates of heat transfer.

As discussed, the gel material in the cooling body container 20 and in the compartments 15, 16 of the base 1, or compartments 33, 34 of the base 3, is a slow-to-freeze, slow-to-thaw material having a freeze cycle of approximately eight hours. However, with insulation, it might be ten to twelve hours. The thaw cycle would be one and a half to two times longer, i.e. twelve to twenty-four hours. Each of the containers 20 or compartments 15, 16 or 33, 34 would be provided with specific amounts of gelatinous material and would be preselectively insulated so that the rate of heat transfer between the liquid in which the apparatus is to be used and the gelatinous material is substantially different. For example, the container 20 might contain three pounds of gelatinous material and each of the compartments of the base 15, 16 or 33, 34 might contain one pound of gelatinous material. One of the base gel compartments might be very thinly insulated (0.26 R-value) and the other compartment might be heavily insulated (0.61 R-value). The cooling body container 20 would be surrounded by heavily insulated thermal material, e.g. 1.14 R-value. Thus, the gel in the container 20 and the gel in each of the compartments of the base may provide two or three different rates of heat transfer between the liquid surrounding the apparatus and the gelatinous material in each of the container and compartments. The amounts of gelatinous material and the insulation for the each of the container and compartments is carefully preselected so that the temperature of the fluid, water W, in the vessel, bait container 10, after placement of bait therein, does not vary more than 5° F. per half hour over a period of at least eight hours.

In a test utilizing the amounts of gelatinous material and the insulation just discussed, and assuming that the gelatinous material had been frozen to a temperature of 10° F. (the capability of any freezers), the apparatus A was placed in a vessel in which the bait water was approximately 85° F. to 90° F. Ambient air was Gulf Coast's summer which reached 90° F. or more. Immediately, heat of the water began to transfer to the gelatinous materials. The heat of course will most quickly transfer to the least insulated compartment 15, 16 and within two to two and a half hours the water was approximately 10° F. cooler than at beginning. During this period of time the heavily insulated compartment 15,16 will have received some heat and will continue to receive more heat for additional four or five hours. After six to seven and one-half hours, the heavily insulated container 20 will have additional 50% heat transfer capacity left and will hold the temperature steady at around 70° F. for approximately two to three hours. After that time, the temperature may increase 2° F. per hour for the next four to six hours, maintaining a survivable temperature for shrimp or other live bait for a total of twelve to fourteen hours and in many cases as long as twenty-four hours if the bait is healthy.

In another test one of the gel compartments 15, 16 was not insulated. The other was insulated the same as the cooling body container with an R value of 1.14. The bait container was placed in a tub of water whose temperature ranged between 80° F. and 84° F. The water in the bait container was initially 90° F. After freezing the gelatinous material, the apparatus A was placed in the bait container. After one hour, the bait water had cooled to 75° F. Over the next eleven hours, the temperature of the bait water did not vary more than 5° F. per hour, reaching a low of 67° F. after four hours and forty-five minutes and rising to 73° F. twelve hours after placing the apparatus A in the bait container.

Thus, the apparatus of the present invention is very effective for cooling and retarding an increase in the temperature of liquid contained in a vessel, specifically water in a bait container. It is so designed that the temperature of the liquid will not be raised or lowered more than 5° F. per half hour in a period of eight to twenty four hours. It is thus very effective in providing a temperature environment for bait in which the bait would be kept alive for long periods of time. Although the present invention has been described for use in a bait container, it is not limited to such use and could be used to keep fish alive (fishing tournaments, etc.) or in any other situation to retard an increase in the temperature of water or other liquids, in a liquid containing vessel due to external influences.

Two or three embodiments of the invention have been described herein. However many variations of the invention can be made without departing from the spirit thereof. Accordingly, it is intended that the scope of the invention be limited only by the claims which follow.

I claim:

1. I claim apparatus for cooling and retarding an increase in the temperature of a liquid contained in a vessel, said apparatus comprising:

a base the outer perimeter of which, when placed in said vessel, substantially occupies the lower interior of said liquid containing vessel; and a cooling body for upward projection from said base so that when said base is placed in said vessel said cooling body projects upwardly from said base for submersion in the liquid in said vessel, said cooling body comprising a sealed container substantially filled with a slow-to-freeze, slow-to-thaw gelatinous material which is to be frozen prior to submersion in said liquid;

said apparatus being further characterized in that the specific weight of said base is enough greater than the specific weight of said liquid to keep said base and said cooling body submerged in said liquid.

2. I claim apparatus as set forth in claim 1 in which said base is a separate unit which has a central opening therethrough, said cooling body being removably insertable through said central opening.

3. I claim apparatus as set forth in claim 2 in which said central opening of said base is circular and said sealed container is frusto-conical in shape, said frusto-conical sealed container having a base of a diameter slightly less than the diameter of said central opening so that when fully inserted, said container base is surrounded by said central opening for disposition at said lower interior of said vessel.

4. I claim apparatus as set forth in claim 3 in which said container base is provided with an annular lip the diameter of which is greater than the diameter of said central opening so that when said sealed container is inserted upwardly through said central opening, said lip prevents said container base from exiting said central opening.

5. I claim apparatus as set forth in claim 1 in which said base is provided with one or more compartments in which weights are placed to increase the specific weight of said base.

6. I claim apparatus as set forth in claim 1 in which said base is provided with one or more compartments in which additional slow-to-freeze, slow-to-thaw gelatinous material placed.

7. I claim apparatus as set forth in claim 6 in which said sealed container and said one or more compartments of gelatinous material are preselectively insulated so that the rate of heat transfer between said liquid and said gelatinous material in said sealed container is substantially different than the rate of heat transfer between said liquid and said gelatinous material in said one or more compartments.

8. I claim apparatus as set forth in claim 6 in which there are at least two compartments of additional slow-to-freeze, slow-to-thaw gelatinous material, said sealed container and each of said two compartments of gelatinous material being preselectively insulated so that the rate of heat transfer between said liquid and said gelatinous material in said sealed container and at least one of said compartments is substantially different.

9. I claim the apparatus in claim 8 in which the rate of heat transfer between said liquid and said gelatinous material in said sealed container is substantially less than the rate of heat transfer between said liquid and said gelatinous material in said at least one of said compartments.

10. I claim the apparatus in claim 6 in which said base is provided with one or more compartments in which weights are placed to increase the specific weight of said base.

11. I claim apparatus for cooling and retarding an increase in the temperature of a liquid contained in a vessel, said apparatus comprising:

a base the outer perimeter of which, when placed in said vessel, substantially occupies the lower interior of said liquid containing vessel, said base having a central opening therethrough; and a cooling body removably insertable through said central opening and which, when fully inserted, projects upwardly from said base for submersion in and exposure to the liquid in said vessel, said cooling body comprising a sealed container substantially filled with a slow-to-freeze, slow-to-thaw gelatinous material which may be frozen prior to submersion in said liquid.

12. I claim apparatus as set forth in claim 11 in which the specific weight of said base is enough greater than the specific weight of said liquid to keep said base and said cooling body submerged in said liquid.

13. I claim the apparatus as set forth in claim 12 in which said base is provided with one or more compartments in which weights are placed to increase the specific weight of said base.

14. I claim the apparatus of claim 11 in which said base is provided with one or more sealed compartments in which additional slow-to-freeze, slow-to-thaw gelatinous material is placed and which are frozen prior to submersion in said liquid.

15. I claim the apparatus of claim 14 in which said sealed container and said sealable compartments are preselectively insulated so that the rate of heat transfer between said liquid and said gelatinous material in said sealed container is substantially different than the rate of heat transfer between said liquid and said gelatinous material in said one or more compartments.

16. I claim the apparatus of claim 15 in which the rate of heat transfer between said liquid and said gelatinous material in said sealed container is substantially less than the rate of heat transfer between said liquid and said gelatinous material in at least one of said one or more compartments.

17. I claim the apparatus of claim 15 in which the insulation in said sealed container and said one or more compartments is selected so that the rate of heat transfer between said liquid and said gelatinous material in said sealed container and said one or more compartments is such that the temperature of said liquid will not be raised or lowered more than 5° F. per half hour for a period of at least eight hours.

18. I claim the apparatus of claim 11 in which said base is provided with first and second sealable compartments in which additional slow-to-freeze, slow-to-thaw gelatinous material may be placed, the gelatinous material in each of said sealed container, said first sealable compartment and said second sealable compartment being surrounded with insulation which provides at least two different rates of heat transfer between said liquid and the gelatinous material in each of said sealed container and said first and second sealable compartments so that the temperature of said fluid does not vary more than 5° F. per half hour over a period of at least eight hours.

19. I claim the apparatus of claim 18 in which the rate of heat transfer between said liquid and the gelatinous material in one of said first and second sealable compartments is less than the other and in which the rate of heat transfer between said liquid and the gelatinous material in said sealed container is less than at least one of said first and second sealable compartments.

* * * * *